US005085197A

United States Patent [19]

Mader et al.

[11] Patent Number: 5,085,197

[45] Date of Patent: Feb. 4, 1992

[54] ARRANGEMENT FOR THE DETECTION OF DEFICIENCIES IN A TANK VENTILATION SYSTEM

[75] Inventors: Gerhard Mader, Thalmassing; Hans Meixner, Haar; Hans Schreiber, Lappersdorf, all of Fed. Rep. of Germany

[73] Assignee: Siemens Aktiengesellschaft, Munich, Fed. Rep. of Germany

[21] Appl. No.: 558,674

[22] Filed: Jul. 26, 1990

[30] Foreign Application Priority Data

Jul. 31, 1989 [EP] European Pat. Off. ..... 89114122

[51] Int. Cl.[5] ..... F02M 33/02

[52] U.S. Cl. ..... 123/520; 123/516; 123/518

[58] Field of Search ..... 123/357, 516, 518, 519, 123/520, 521

[56] References Cited

U.S. PATENT DOCUMENTS

| | | | |
|---|---|---|---|
| 4,013,054 | 3/1977 | Balsley et al. | 123/519 |
| 4,159,698 | 7/1979 | Berenbaum | 123/516 |
| 4,641,623 | 2/1987 | Hamburg | 123/518 |
| 4,696,277 | 9/1987 | Katayama | 123/479 |
| 4,700,682 | 10/1987 | Ota et al. | 123/516 |
| 4,748,959 | 6/1988 | Cook et al. | 123/520 |
| 4,809,667 | 3/1989 | Uranishi et al. | 123/518 |
| 4,817,576 | 4/1989 | Abe et al. | 123/516 |
| 4,821,701 | 4/1989 | Nankee, II et al. | 123/520 |
| 4,831,992 | 5/1989 | Jundt et al. | 123/520 |
| 4,841,938 | 6/1989 | Weibler et al. | 123/494 |
| 4,872,439 | 10/1989 | Sonoda et al. | 123/516 |
| 4,887,578 | 12/1989 | Woodcock et al. | 123/516 |
| 4,949,695 | 8/1990 | Uranishi et al. | 123/520 |
| 4,961,412 | 10/1990 | Furuyama | 123/357 |
| 4,967,713 | 11/1990 | Kojima | 123/518 |

FOREIGN PATENT DOCUMENTS

| | | |
|---|---|---|
| 2621081 | 3/1989 | France . |
| 2210710A | 6/1989 | United Kingdom . |

*Primary Examiner*—E. Rollins Cross
*Assistant Examiner*—Thomas N. Moulis
*Attorney, Agent, or Firm*—Hill, Van Santen, Steadman & Simpson

[57] ABSTRACT

With the present tank ventilation system formed of a fuel tank, an active carbon filter, a control unit, a lambda probe, a tank ventilation valve and a flow sensor it is possible to recognize defects at the connecting lines and the ventilation valve immediately. For the recognition of the defect, a control unit is provided which examines the signals arriving from the lambda probe and from the flow sensor along with the outgoing tank ventilation control signals for unreasonable events. When a defect is recognized, the error signal is stored. A ceramic PTC resistor is preferably employed as the flow sensor.

8 Claims, 1 Drawing Sheet

DEFECT CONDITION TABLE

| CONDITION | GAS FLOW SIGNAL | VENTILATION VALVE CONTROL SIGNAL | LAMBDA PROBE SIGNAL |
|---|---|---|---|
| 1 | FLOW | CLOSED | |
| 2 | NO FLOW | OPEN | |
| 3 | | OPEN | UNCHANGED |

DEFECT CONDITION TABLE

| CONDITION | GAS FLOW SIGNAL | VENTILATION VALVE CONTROL SIGNAL | LAMBDA PROBE SIGNAL |
|---|---|---|---|
| 1 | FLOW | CLOSED | |
| 2 | NO FLOW | OPEN | |
| 3 | | OPEN | UNCHANGED |

ARRANGEMENT FOR THE DETECTION OF DEFICIENCIES IN A TANK VENTILATION SYSTEM

BACKGROUND OF THE INVENTION

The relates to an arrangement for the detection of defects in a tank ventilation system. In the case of known tank ventilation systems, the fuel vapors that develop in the fuel tank are stored in an active carbon filter and are guided into the combustion chamber of the engine periodically after the opening of a ventilation valve.

In these known tank ventilation systems, deficiencies can occur at the connecting lines and the air valve without every defect being immediately recognized. The connecting pipes can be plugged up or leaky, or the air valve can no longer open or close. The consequence thereof is that, until the defect has accidentally been discovered, the tank ventilation system does not operate correctly and the fuel vapors escape into the atmosphere.

SUMMARY OF THE INVENTION

Therefore, it is an object of the invention to create a tank ventilation system whereby deficiencies in the system are detected as promptly as possible.

This problem is solved by providing a system for the detection of defects in a tank ventilation system wherein in a line between an output of the filter to an intake portion of the internal combustion engine a flow sensor is arranged which supplies a flow signal to the control unit. A lambda probe may also be provided which supplies a probe signal to the control unit, the lambda probe being provided at an exhaust portion of the internal combustion engine. Means are provided for comparing the at least one of flow signal from the flow sensor or the probe signal from the lambda probe to a control signal which actuates the tank ventilation valve. An error signal is provided in the case of a logically unreasonable comparison of these signals which is indicative of a defect in the tank ventilation system.

DESCRIPTION OF THE PREFERRED EMBODIMENTS

Figures 1, 2:
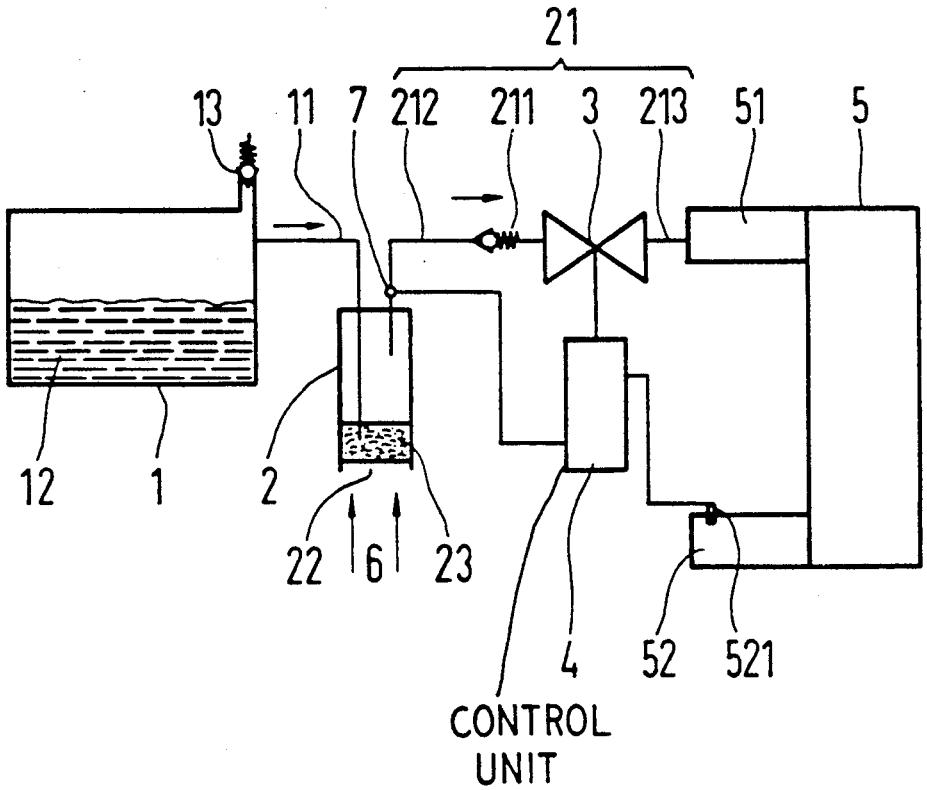
FIG. 1 illustrates in schematic fashion an arrangement according to the invention for the detection of defects in a tank ventilation system.
FIG. 2 is a table showing the defect conditions identified by the control unit 4 according to the invention.

The drawing FIG. 1 shows schematically the elements of a tank ventilation system with defect detection according to the invention. The fuel vapors developing in the tank 1 are directed via a connecting pipe 11 into the active carbon filter 2. From the active carbon filter 2 a connecting line 21 leads to the intake section 51 of the internal combustion engine 5 via a tank ventilation or air valve 3. Via a control signal, the tank ventilation valve 3 can be electrically actuated and controlled by the control unit 4. Between the active carbon filter 2 and the tank air valve 3, a flow sensor 7 is arranged which supplies a flow signal to the control unit 4 given a gas flow in the connecting line 21. In the exhaust section 52 sits a lambda probe 521, which delivers a probe signal to the control unit 4.

The following describes the proper functioning of the tank ventilation. The fuel 12 in the fuel tank 1 vaporizes and is guided via the connecting pipe 11 into the filter insert 23 of the active carbon filter 2. The filter insert 23 has a limited reception capacity and must therefore be emptied out periodically with rinsing or cleaning air 6. For this, the tank air valve 3 is opened by the control unit 4. The underpressure prevailing in the intake section 51 of the internal combustion engine 5 continues via the connecting line 21, the tank air valve 3 and an excess pressure valve 211 into the active carbon filter 2. The under-pressure prevailing in the active carbon filter 2 causes the cleaning or rinsing air 6 to pass onto the active carbon filter 2 via the air inlet opening 22, and causes this air to stream through the filter insert 23. Thus, the fuel vapors contained in the filter insert 23 are released and flow all the way into the intake section 51 of the internal combustion engine 5. The flow sensor 7 detects whether gas is leaking from the active carbon filter 2. The excess pressure valve 211 prevents the overincreases of pressure in the intake section 51 which occur during the dynamic operation of the internal combustion engine 5 (known to the person skilled in the art as pulsations or resonances) from reaching the active carbon filter 2.

In the event that the connecting line 11 is leaky, fuel vapors get into the atmosphere at the leaky location. If the connecting line 11 is plugged up, however, the fuel vapors get into the atmosphere via the excess pressure valve 13 of the fuel tank 1. In case of a disturbance in or at the connecting line 11, thus no fuel vapor gets into the active carbon filter 2. When the active carbon filter 2 is cleaned or rinsed via actuation of the tank air valve 3, the air supplied to the intake section 51 would thus contain no fuel portions. In the case of a normal functioning of the tank ventilation, however, fuel portions would be supplied to the engine which would be noticeable as a change of the probe signal delivered by the lambda probe 521 to the control unit 4. Thus, the control unit 4 recognizes the existing defect since, given an open tank air valve 3, no change of the values provided by the lambda probe 521 occurs. Thus, the case may occur that, after the actuation of the tank air valve 3, the mixture supplied to the intake section 51 accidentally has the same distribution of air and fuel as the mixture delivered to the internal combustion engine via a mixture generation unit not shown here. Although at first no change of the probe signals will result, a continued cleaning or rinsing of the filter insert 23 results in a change of the ratio of air and fuel which, in turn, is noticeable as a change of the probe signals.

When the sectional piece 212 of the connecting line 21 between the active carbon filter and the tank air valve 3 is clogged up or leaky, no under-pressure effects the active carbon filter 2. Thus, the flow sensor 7 detects no more flow. From the logical operation "tank ventilation valve open—flow sensor 7 delivers no signal", the control unit 4 recognizes that a defect exists.

Two types of defects can occur at the tank ventilation valve 3: The tank ventilation valve 3 does not open—defect (A)—or does not close—defect (B).

If the tank ventilation valve 3 does not open, the flow sensor 7 detects no air flow. From the logical connection "tank ventilation valve 3 open—no flow signal from the flow sensor 7", a defect is detected. If the tank ventilation valve 3 does not close, the logical connection "tank ventilation valve closed—flow sensor 7 delivers signal" reveals a defect.

Given a defect in the sectional part 213 of the connecting line 21 between valve 3 and intake section 51, the situation is the same as in the case of a defect in the part 212 of the connecting line 21. Here, too, the control unit 4 recognizes from the logical operation "tank ventilation valve open—flow sensor 7 delivers no flow signal" that a defect exists.

FIG. 2 in the drawings is a table summarizing the above described defect detection performed by simple logic circuitry or programming of the control unit 4.

Regarding the technical realization it would be favorable to use a thermal mass flow sensor as flow sensor 7. Based on the self-regulation effect in the case of ceramic PTC resistors and the small circuit expense associated therewith, preferably a ceramic PTC resistor is employed as a flow sensor 7.

Although various minor changes and modifications might be proposed by those skilled in the art, it will be understood that we wish to include within the claims of the patent warranted hereon all such changes and modifications as reasonably come within our contribution to the art.

WE CLAIM AS OUR INVENTION:

1. An arrangement for the detection of defects in a tank ventilation system having a fuel tank, an active carbon filter having an input connected to an output of the fuel tank, a tank ventilation valve connected between an intake section of an internal combustion engine and an output of the active carbon filter, a lambda probe at an exhaust section of the internal combustion engine which generates a probe signal, and a control unit which provides a control signal for actuating the tank ventilation valve so as to either open or block gas flow from the output of the filter to the intake section of the internal combustion engine, comprising:

flow sensor means arranged to measure the gas flow from the output of the filter to the tank ventilation valve and for generating a corresponding flow signal; and said control unit having means for comparing said probe signal from the lambda probe to the control signal which actuates the tank ventilation valve, and for providing an error signal in case the probe signal from the lambda probe remains unchanged for a defined period of time when the control signal being supplied is for opening the control valve.

2. An arrangement for the detection of defects in a tank ventilation system having a fuel tank, an active carbon filter having an input connected to an output of the fuel tank, a tank ventilation valve connected between an intake section of an internal combustion engine and an output of the active carbon filter, and a control unit which provides a control signal for actuating the tank ventilation valve so as to either open or block gas flow from the output of the filter to the intake section of the internal combustion engine, comprising:

a flow sensor means arranged to indicate a gas flow from the output of the filter to the tank ventilation valve and for generating a corresponding flow signal, said flow sensor means comprising a ceramic PTC resistor in series with a drop resistor which is not exposed to the gas flow; and said control unit having means for comparing said flow signal to the control signal which actuates the tank ventilation valve, and for providing an error signal in the case of one of the conditions:

(1) the control signal being supplied is for closing the air valve and the flow signal indicates gas flow; or (2) the control signal being supplied is for opening the air valve and the flow signal indicates no gas flow.

3. An arrangement according to claim 2 wherein the connecting wires of the PTC resistor comprise an iron-nickel alloy.

4. An arrangement according to claim 2 wherein the flow sensor means is attached between the active carbon filter and the ventilation valve.

5. An arrangement according to claim 2 wherein the drop resistor has a non-linear resistance whose characterization curve compensates a dependency of the flow signal on environmental temperature.

6. A method for the detection of defects in a tank ventilation system having a fuel tank, an active carbon filter having an input connected to an output of the fuel tank, a tank ventilation valve connected between an intake section of an internal combustion engine and an output of the active carbon filter, a lambda probe at an exhaust section of the internal combustion engine which generates a probe signal, and a control unit which provides a control signal for actuating the tank ventilation valve so as to either open or block gas flow from the output of the filter to the intake section of the internal combustion engine, comprising steps of:

comparing the probe signal of the lambda probe to the control signal which actuates the tank ventilation valve, and providing an error signal if the probe signal from the lambda probe remains unchanged for a defined period of time and if the control signal being supplied is for opening the control valve.

7. A method for the detection of defects in a tank ventilation system having a fuel tank, an active carbon filter having an input connected to an output of the fuel tank, a tank ventilation valve connected between an intake section of an internal combustion engine and an output of the active carbon filter, and a control unit which provides a control signal for actuating the tank ventilation valve so as to either open or block gas flow from the output of the filter to the intake section of the internal combustion engine, comprising steps of:

measuring a gas flow from the filter to the tank ventilation valve and generating a corresponding flow signal; and comparing said flow signal to the control signal which actuates the tank ventilation valve, and providing an error signal if the control signal being supplied is for closing the air valve and the flow signal indicates gas flow.

8. A method according to claim 7 wherein the error signal is also provided if the control signal being supplied is for opening the air valve and the flow signal indicates no gas flow.

* * * * *